United States Patent [19]

Ohyaba et al.

[11] 4,413,160

[45] Nov. 1, 1983

[54] RIBBON-TYPE LOUDSPEAKER

[75] Inventors: Takashi Ohyaba; Yoichi Suzuki, both of Tokorozawa, Japan

[73] Assignee: Pioneer Electronic Corporation, Tokyo, Japan

[21] Appl. No.: 355,244

[22] Filed: Mar. 5, 1982

[30] Foreign Application Priority Data

Mar. 10, 1981 [JP] Japan ..... 56-32226[U]

[51] Int. Cl.[3] ..... H04R 11/00

[52] U.S. Cl. ..... 179/115 V; 179/115 R; 179/117; 179/181 R

[58] Field of Search ..... 179/115.5 PV, 115.5 PS, 179/115 R, 117 R, 115 V, 181 R, 115.5 R

[56] References Cited

FOREIGN PATENT DOCUMENTS 55-99898 7/1980 Japan ..... 179/115.5 PV 2081551 2/1982 United Kingdom ..... 179/115.5 R

*Primary Examiner*—G. Z. Rubinson

*Assistant Examiner*—Danita R. Byrd

[57] ABSTRACT

The ribbon-type loudspeaker that has the characteristics of large cooling effect such that electrical input power is increased. The ribbon-type loudspeaker comprises magnet means having plates positioned in facing relation to each other to form a gap therebetween; an electrically conductive diaphragm extended between said plates to complete a magnetic circuit, said diaphragm forming an electric circuit transversely of said magnetic circuit, at least one side of said diaphragm being formed with an electrically insulating layer; and a heat absorbing plate extended between said plates and attached in contacting relation thereto over an extended area, said heat absorbing plate being formed with an electrically insulating layer in facing relation to the electrically insulating layer of the diaphragm.

7 Claims, 5 Drawing Figures

RIBBON-TYPE LOUDSPEAKER

BACKGROUND OF THE INVENTION

The present invention relates to the ribbon-type loudspeaker that has the characteristics of large effects of heat radiation such that electrical input power is increased.

In the prior art, the diaphragm of the ribbon-type loudspeaker must meet two requirements: light-weight and large conductivity. To meet these two requirements, there has conventionally been used ribbon-type diaphragm made of conductive metal foil alone such as aluminium foil or ribbon-type diaphragm made of high-polymer film with its one side or both sides formed with conductive portion.

On the other hand, the effective cooling of the diaphragm has been required, because allowable electrical input power for the loudspeaker must be increased. Without effective cooling a ribbon-type diaphragm is fused due to heat generated therein (Joule's heat). Or, the input power is apt to subject the ribbon-type diaphragm to thermal deformation before fusion takes place.

In the prior art ribbon-type diaphragm, heat propagation takes place through three paths as shown in FIG. 1.

The path A conducts heat directly from the diaphragm to the air therearound. The path B conducts heat to the plates 4 of the magnetic circuit 2 and the metalic frame (not shown) via the viscoelastic seal elements 5 holding both ends of said diaphragm 1'. The path C is space around the diaphragm through which heat radiates directly from the diaphragm. In this way, cooling of the diaphragm takes place Among these three paths, both path B that conducts heat from the diaphragm 1' to the plates 4 of the magnetic circuit 2 via seal elements 5 and path A that conducts heat directly to the air from the oscillating element 1' are main passages of heat propagation at a low temperature of the diaphragm 1'.

For example, as shown in FIG. 1, the path B that propagates heat due to heat conduction to the plates 4 of the magnetic circuit 2 via seal elements 5 contributes to greater heat propagation than the path C.

On the other hand, at a high temperature of the diaphragm 1', the other path C that propagates heat by radiation works more efficiently than others.

Now, heat propagation Q through the path C is indicated in the following general equation;

$$Q=A\epsilon\delta T^4$$

where A is an effective area emanating (or absorbing) heat, $\delta$ is Stephan-Boltzmann's constant, and T is the absolute temperature of A [°K].

Although large emmissivity $\epsilon$ is needed in order to obtain large Q, in the very case of the metal used generally to the oscillating element of the ribbon-type loudspeaker such as aluminium or the like, the generally-obtained value of $\epsilon$ is as low as 0.04.

SUMMARY OF THE INVENTION

Therefore, the object of the present invention is to provide the ribbon-type loudspeaker which has high output sound pressure through effective cooling by making use of mainly radiation at a high temperature within the limitation of the allowable input current. For this purpose, an electrically insulating layer is formed on the back side of the diaphragm of conductive metal foil and another insulating layer is formed, in facing relation to said layer on the diaphragm, on the heat absorbing plate attached to both plates of magnetic circuit.

DESCRIPTION OF THE PREFERRED EMBODIMENT

Figure 3:
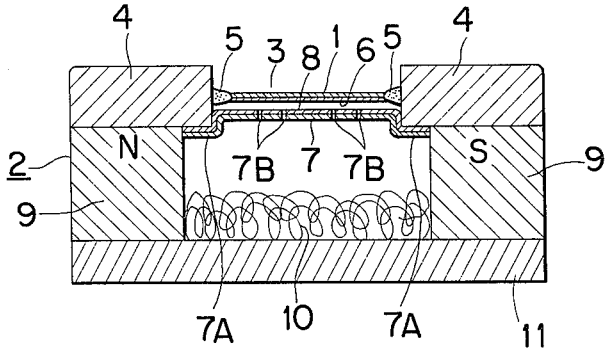
FIG. 3 is a cross-sectional view of an embodiment of the invention illustrating ribbon-type loudspeaker.
Figure 2:
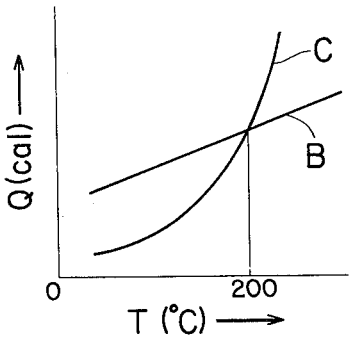
FIG. 2 is a characteristic diagram illustrating the relationship between the temperature of the diaphragm T and amount of heat propagation Q through a path which conducts heat to the plates of the magnetic circuit and through another path which propagates heat by radiation.

Preferred embodiments of the present invention will be described with reference to the accompanying drawings, FIG. 3 and FIG. 4.

The numeral 1 designates a diaphragm of electrically conductive metal foil of simple substance such as aluminium or the like, and said diaphragm 1 has both its front and rear ends fixed firmly to form an electric circuit transversely in the magnetic gap 3 of the magnetic circuit 2, and said diaphragm has both its right and left ends adhered and held to plates 4 of the magnetic circuit 1 through viscoelastic seal material 5.

The numeral 6 designates an electrically insulating layer formed on the back side of said diaphragm 1, and said layer 6 can be easily formed by painting or direct oxidation treatment.

In the case of electrically insulating layer 6 of alumite, the value of emissivity $\epsilon$ is 0.8 to 0.9.

In the case of layer 6 formed by coating material containing epoxy-thermosetting resin as main ingredients through bake painting or bake printing, the value of the emissivity $\epsilon$ is 0.8 to 0.9.

Then both the values of $\epsilon$ for the two cases are extremely larger than the value of $\epsilon$: 0.04 for usual aluminium metal surface.

The numeral 7 designates an heat absorbing plate of, for example, metallic material. Said heat absorbing plate has shouldered portions 7A at its both ends. Said heat absorbing plate is attached to the plates 4 of the magnetic circuit 2 such that the shouldered portions snugly contact the pole pieces 4 over an extended area to increase heat conduction. A plurality of apparatus 7B are opened in the said heat absorbing sheet 7. A backward sound pressure from the diaphragm through said apertures 7B is absorbed in a sound absorbing material 10 packed in the recess defined by magnets 9, which is explained hereinafter.

The numeral 8 designates an electrically insulating layer formed on the surface of the heat absorbing plate 7 and of the same material as the layer 6 by bake painting or through oxidation process, said layer 6 facing said electrically insulating layer 6.

The numeral 9 designates magnet, 10 designating sound absorbing material packed in the recess defined by magnets 9.

A yoke 11 connects said magnets 9 to form a magnetic circuit. The diagphragm 1 of electrically conductive metal foil such as aluminium or the like generates heat when voice current passes therethrough for sound reproduction. At a relatively low temperature such heat emanates, taking path B i.e. from the diaphragm 1 through viscoelastic seal material 5, pole pieces 4, magnets 9 to a frame (not shown) while taking path A by heat conduction directly into the air. On the other hand, the amount of heat radiation which takes path C is relatively small at such a low temperature. However, the greater part of heat at a higher temperature emanates from the diaphragm 1, taking the path C into the air by radiation.

The general equation is as follows:

$$Q=A\epsilon\delta T^4$$

Figure 1:
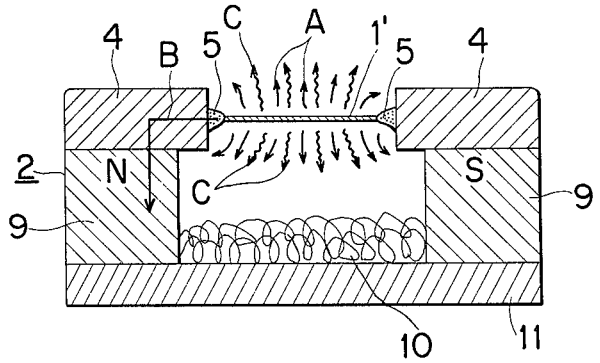
FIG. 1 is a cross-sectional view illustrating a prior art ribbon-type loudspeaker.

The above equation makes the foregoing explanation easy to understand. That is, extremely large portion of amount Q is obtained at around the melting point of aluminium since $\epsilon$ and T are major factors for propagating heat. This is partly because the emissivity $\epsilon$ having a value ranging from 0.8 to 0.9 is obtained, which is larger than the emissivity $\epsilon$ of the conventional diaphragm 1' of metal foil alone without electrically insulating layer 6 as shown in FIG. 1. Another reason is that the amount of propagated heat Q changes in proportioned to absolute temperature T to the 4-th power. The above description shows that it is more effective to propagate heat by heat radiation than by heat conduction or convection.

Figure 4:
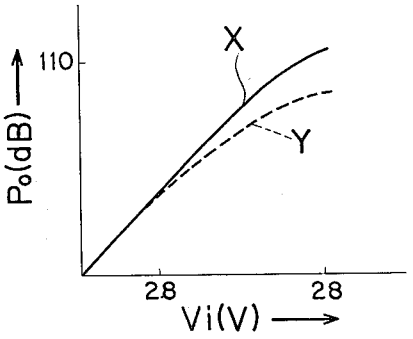
FIG. 4 is a characteristic diagram illustrating the relationship between input voltage Vi and output sound pressure $P_o$ in both cases of good and poor cooling performances from the diaphragm.

The relationship between the input voltage Vi and output sound pressure $P_o$ of the diaphragm 1 is exhibited in FIG. 4, in which the solid curve X shows good heat propagation whereas the dashed curve Y shows poor heat propagation, indicating that better heat propagation from the diaphragm 1 leads to larger output sound pressure in proportion to the same input voltage.

It follows that the diaphragm with the electrically insulating layer 6 propagates heat more effectively than the conventional diaphragm without insulating layer 6. As a result, large input current can be used since temperature rise of the diaphragm 1 with respect to an input voltage is retained at a low level. In this embodiment, the heat absorbing plate 7 is attached between the plates 4 such that said heat absorbing plate may face the electrically insulating layer 6 formed on the back side of said diaphragm 1 of metal foil alone. Besides, said heat absorbing sheet 7 is attached such that the shouldered portion 7A, of its both ends contact pole pieces 4 over an extended area. As a result, a generated heat in the diaphragm 1 is absorbed efficiently through path B into the plates 4 through viscoelastic seal materials 5. Besides heat propagated to the heat absorbing plate 7 through path A and path C is further conducted efficiently to the plates 4, to be propagated to the outside.

Additionally, the electrically insulating layer 6 formed on the heat absorbing plate in facing relation to the electrically insulating layer 6 formed on the diaphragm 1 increases the emissivity from the diaphragm to the heat absorbing plate 7.

In this way, at a high temperature of the diaphragm 1, the heat absorbing plate 7 will absorb the radiant heat from the diaphragm with good efficiency, thus increasing heat propagation from said heat absorbing sheet 7 via plates 4 to the outside.

In the above embodiment, the electrically insulating layer 6 is formed only on the back side of the diaphragm 1 made of electrically conductive metal foil alone, in order to use the aluminium surface of the diaphragm 1 exposed outward for aesthetic purposes. However, it is possible to form the electrically insulating layer 6 on the both surfaces of the diaphragm 1 in order to make the radiant effect more significant.

Figure 5:
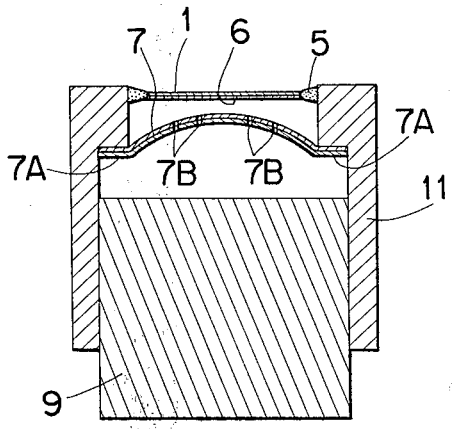
FIG. 5 is another embodiment of the present invention.

The present invention may take the form of an embodiment as shown in FIG. 5, wherein magnet 9 is held between two parallelly upstanding yokes 11. In this embodiment, a diaphragm 1 which has the same structure as that of the embodiment in FIG. 3 extends across the plates 4 attached to the bent top portions of the yokes 11 by way of viscoelastic material 5 whereas heat absorbing plate 7 extends two yokes between the diaphragm 1 and the magnet 9. Needless to say, the heat absorbing plate 7 has the same structure as that of the FIG. 3 embodiment.

This present invention incorporates a diaphragm having the electrically insulating layer on its backside and the heat absorbing plate having an insulating layer facing said insulating layer of the diaphragm.

As a result, excellent cooling effect is obtained and output sound pressure has becomes larger in proportion to increased allowable input current.

What is claimed is:

1. A ribbon-type loudspeaker comprising
magnet means;
an electrically conductive diaphragm provided within said magnet means to complete a magnetic circuit, said diaphragm forming an electric circuit transversely of said magnetic circuit, at least one side of said diaphragm being formed with an electrically insulating layer; and
a heat absorbing plate extended within said magnet means and attached in contacting relation thereto over an extended area, said heat absorbing plate being formed with an electrically insulating layer in facing relation to the electrically insulating layer of the diaphragm.

2. A ribbon-type loudspeaker according to claim 1, wherein said magnet means includes two magnets and a yoke connecting said two magnets.

3. A ribbon-type loudspeaker according to claim 2, wherein said heat absorbing plate is positioned between the electrically conductive diaphragm and the yoke.

4. A ribbon-type loudspeaker according to claim 3, wherein said heat absorbing plate has a plurality of apertures therein.

5. A ribbon-type loudspeaker according to claim 1, wherein said magnet means includes one magnet and two yokes parallelly extending to hold the magnet therebetween, the diaphragm extending across said two yokes, the heat absorbing plate extending across said two yokes between said diaphragm and magnet.

6. A ribbon-type loudspeaker according to claim 1, wherein said electrically insulating material of the diaphragm and the heat absorbing plate is a member selected from the group consisting of epoxy-thermosetting resin and metal oxide.

7. A ribbon-type loudspeaker according to claim 1, wherein said diaphragm is made of metal foil, said at least one side formed with the electrically insulating layer consisting of a side facing inwardly of the magnetic circuit such that the other side thereof is of metallic surface.

* * * * *